US007225735B2

(12) United States Patent
Zuber et al.

(10) Patent No.: US 7,225,735 B2
(45) Date of Patent: Jun. 5, 2007

(54) METHOD FOR ROLLER ADJUSTMENT IN A PRINTING PRESS

(75) Inventors: Mathias Zuber, Helmstadt-Bargen (DE); Ulrich Luckhardt, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 111 days.

(21) Appl. No.: 11/105,991

(22) Filed: Apr. 14, 2005

(65) Prior Publication Data

US 2005/0241501 A1 Nov. 3, 2005

(30) Foreign Application Priority Data

May 3, 2004 (DE) ..... 10 2004 022 001

(51) Int. Cl.
*B41L 35/00* (2006.01)

(52) U.S. Cl. ..... 101/148; 101/350.1

(58) Field of Classification Search ..... None
See application file for complete search history.

(56) References Cited

U.S. PATENT DOCUMENTS 2,257,261 A 9/1941 Knowlton
2,762,295 A * 9/1956 Varga et al. ..... 100/158 R
3,019,727 A * 2/1962 Lake ..... 101/148
3,343,484 A 9/1967 Dahlgren
3,673,959 A * 7/1972 Jezuit et al. ..... 101/148
3,744,414 A 7/1973 Kröchert et al.
5,186,100 A * 2/1993 Turturro et al. ..... 101/40
6,460,455 B1 * 10/2002 Eltner et al. ..... 101/148

FOREIGN PATENT DOCUMENTS

| | | |
|---|---|---|
| DE | 2 054 678 | 10/1972 |
| EP | 0 700 782 A2 | 3/1996 |
| EP | 0 722 830 A2 | 7/1996 |
| FR | 2 561 584 | 9/1985 |

* cited by examiner

*Primary Examiner*—Daniel J. Colilla
*Assistant Examiner*—Jill E. Culler
(74) *Attorney, Agent, or Firm*—Laurence A. Greenberg; Werner H. Stemer; Ralph E. Locher

(57) ABSTRACT

Methods for performing a roller adjustment in a printing press include an axial spacing adjustment and an oblique position adjustment. The oblique position adjustment is carried out along a straight line of movement which extends perpendicularly relative either to another straight line of movement of the axial spacing adjustment or to a tangential line of a pivoting circular arc of the axial spacing adjustment.

10 Claims, 6 Drawing Sheets

METHOD FOR ROLLER ADJUSTMENT IN A PRINTING PRESS

BACKGROUND OF THE INVENTION

Field of the Invention

The present invention relates to methods for roller adjustment in a printing press, and arose because of the now described background.

A dip roller and a metering roller are in contact with one another under pressure in the damping unit of lithographic printing presses. As a result of the pressure, the rollers are deflected axially. In turn, the deflection of the rollers has the consequence that the damping solution metering is not uniform along the roller nip. It is not possible to equalize the nonuniform damping solution metering by adjusting an axial spacing, which exists between the rotational axis of the dip roller and the rotational axis of the metering roller. The axial spacing adjustment serves another purpose.

In non-prosecuted, published German application DE 2054 678, the non-uniform damping solution metering is equalized by the adjustment of an oblique position of the metering roller relative to the dip roller. The metering roller is mounted in levers, which are disposed so as to be pivotable about the rotational axis of the dip roller. In order to adjust the metering roller obliquely relative to the dip roller, either only one lever or only the other lever is pivoted. As a consequence of the pivoting of the lever, one roller end of the metering roller is pivoted along an arcuate line of movement and the metering roller is, as it were, "wound" around the dip roller to a slight extent in a helical manner. This winding would be associated with an excessive increase in the roller pressure in the center of the roller nip if the metering roller were not formed in a diabolo shape, in such a way as is, however, the case in the abovementioned published document.

However, it is easier to manufacture rollers, which are not in the shape of a diabolo, but rather to be ideally cylindrical.

Axial spacing adjustment which can be carried out independently of the oblique position adjustment of the metering roller can be carried out in the damping unit in the abovementioned published document by use of eccentric bushes, via which the metering roller is mounted at its two ends in the levers. The metering roller is adjusted to a greater or smaller axial spacing relative to the dip roller by rotation of the eccentric bushes.

According to French patent FR 2 561 584, the dip roller is wound around the metering roller during its oblique position adjustment. Here, one roller end of the dip roller is pivoted along an arcuate line of movement. An excessive increase in the roller pressure at the center of the roller nip is prevented by the diabolo shape of the dip roller. Axial spacing adjustment of the dip roller that can be carried out independently of the oblique position adjustment is possible. In order to adjust the dip roller to a greater or smaller axial spacing relative to the metering roller here, the dip roller is moved along a straight line of movement that is defined by slotted guides.

The oblique position adjustment of the respective roller which is to be adjusted obliquely is also carried out in U.S. Pat. No. 2,257,261 and U.S. Pat. No. 3,343,484 by its movement along an arcuate line of movement and thus by helical winding of one roller around the other.

European patents EP 0 700 782 B1 and EP 0 722 830 B1 contain further prior art embodiments.

SUMMARY OF THE INVENTION

It is accordingly an object of the invention to provide a method for roller adjustment in a printing press which overcomes the above-mentioned disadvantages of the prior art methods of this general type.

The two methods according to the invention are based on one and the same adjustment principle.

In one method according to the invention for roller adjustment in a printing press which contains a first roller and a second roller which is in contact with the first roller, an axial spacing adjustment of one of the rollers relative to the other one of the rollers is carried out along a straight, first line of movement and an oblique position adjustment of one of the rollers relative to the other one of the rollers is carried out along a straight, second line of movement which extends perpendicularly with respect to the first line of movement.

In the other method according to the invention for roller adjustment in a printing press which contains a first roller and a second roller which is in contact with the first roller, an axial spacing adjustment of one of the rollers relative to the other one of the rollers is carried out along a pivoting circular arc and an oblique position adjustment of one of the rollers relative to the other one of the rollers is carried out along a straight line of movement which extends perpendicularly with respect to a tangential line of the pivoting circular arc. The tangential line extends through a rotational axis of the roller that is moved along the pivoting circular arc during the axial spacing adjustment.

In the oblique position adjustment, which is also called offsetting in the following text, the roller which is to be positioned obliquely is set obliquely without impairment of the axial spacing adjustment which is also denoted in the following text as feed setting. In turn, the axial spacing adjustment is carried out without impairment of the oblique position adjustment. The axial spacing adjustment and the oblique position adjustment are thus carried out independently of one another and without any reaction effect on one another.

In the two methods according to the invention, in each case four variants are possible for assigning the feed setting movement (axial spacing adjustment) and the offsetting movement (oblique position adjustment) to the two rollers. According to a first variant, in the spacing adjustment, the first roller is moved or set relative to the second roller and, in the oblique position adjustment, the first roller is moved or offset relative to the second roller. According to a second variant, in the axial spacing adjustment, the second roller is moved relative to the first roller and, in the oblique position adjustment, the second roller is moved relative to the first roller. According to a third variant, in the axial spacing adjustment, the first roller is moved relative to the second roller and, in the oblique position adjustment, the second roller is moved relative to the first roller. According to a fourth variant, in the axial spacing adjustment, the second roller is moved relative to the first roller and, in the oblique position adjustment, the first roller is moved relative to the second roller. In the variants described, the feed setting movement and the offsetting movement can thus be performed preferably by one and the same roller or by different rollers of the pair of rollers.

As has already been mentioned, the two methods according to the invention are based on one and the same adjustment principle in that the roller which is to be set obliquely is moved along a straight line of movement which extends perpendicularly with respect to a line which is associated with the axial spacing adjustment. In accordance with the method according to the invention which was mentioned first, the other line which is associated with the axial spacing adjustment is likewise a straight line of movement and, in accordance with the other method according to the invention, the other line which is associated with the axial spacing adjustment is a tangential line which lies on the pivoting circular arc of the axial spacing adjustment. The offsetting direction and the feed setting direction are thus substantially perpendicular with respect to one another in both methods according to the invention.

In the methods according to the invention, the oblique position adjustment does not cause an excessive increase in the roller pressure at the axial center of the roller nip, which is formed by the two rollers, but instead causes a reduction of the roller pressure at the ends of the roller nip, which is within tolerable limits. For this reason, the methods according to the invention are also suitable for the adjustment of rollers having an ideally cylindrical configuration.

According to one development, one of the two rollers is a dip roller. Here, either the first roller or the second roller can be the dip roller. The other of the two rollers, which is in contact with the dip roller can be a metering roller.

According to a further development, a first roller end and a second roller end of the roller, which is adjusted during the oblique position adjustment are displaced in opposite directions to one another. Here, although both roller ends of the roller, which is to be offset are moved along the straight line of movement, they are moved in opposite directions of movement to one another. In an oblique position adjustment of this type, the first roller end can be displaced further than the second roller end. For example, the adjusting path which the first roller end travels to the left along the straight line of movement in the oblique position adjustment can be greater than the adjusting path which the second roller end in this same oblique position adjustment covers to the right along the straight line of movement. Manufacturing faults of the rollers or of their elastomeric roller covers which are asymmetrical with regard to the roller length can be compensated for by the different movement lengths of the two roller ends, asymmetrical axial deflection of the rollers can be compensated for and asymmetrical damping solution metering across the printing width can be set, which metering can be necessary on account of a pronouncedly asymmetrical subject.

The invention also includes a printing press having a damping unit, which contains an adjustable roller mounting, which is configured in a suitable manner for carrying out one or the other method according to the invention or their developments.

Other features which are considered as characteristic for the invention are set forth in the appended claims.

Although the invention is illustrated and described herein as embodied in a method for roller adjustment in a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
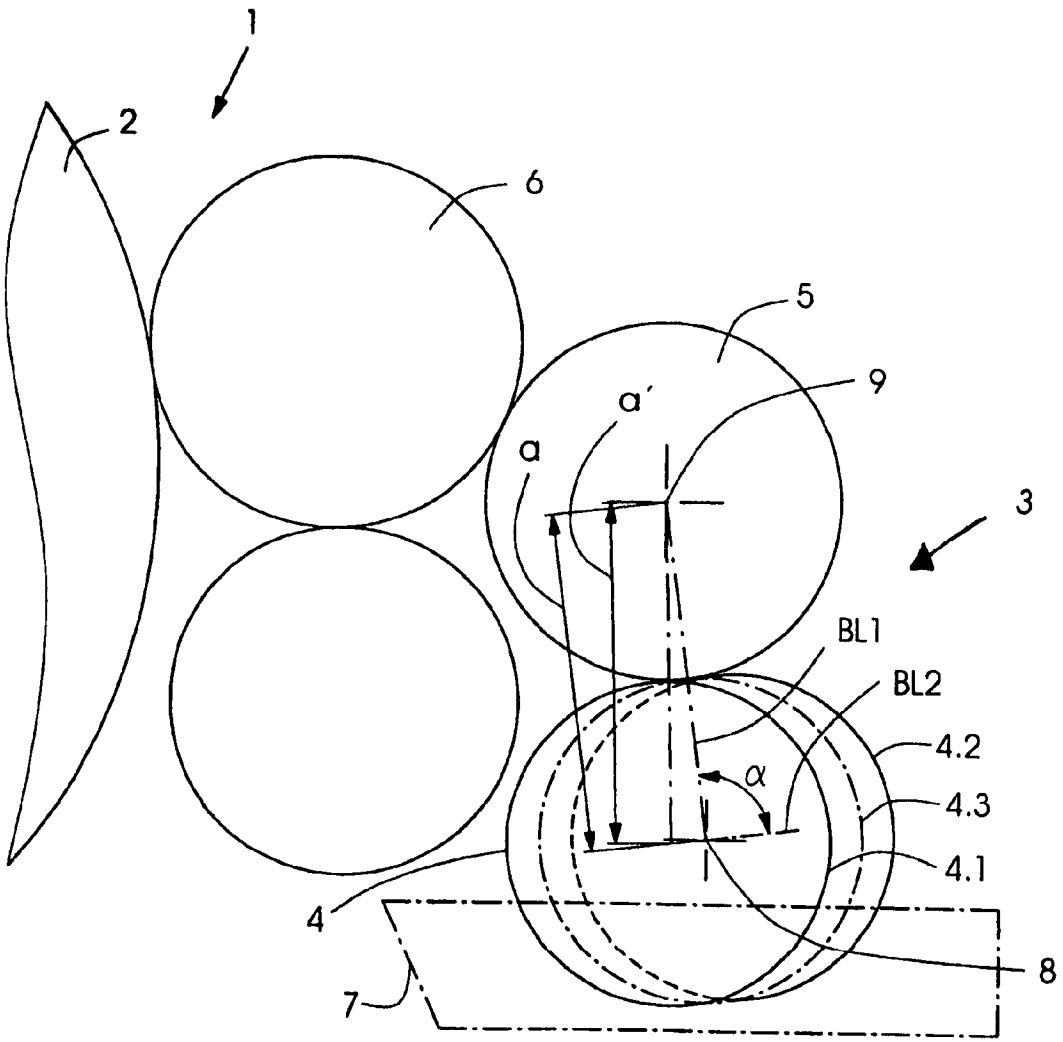
FIG. 1 is a diagrammatic illustration of a first exemplary embodiment, in which a dip roller is offset and a feed setting is carried out along a straight line.

In all the figures of the drawing, sub-features and integral parts that correspond to one another bear the same reference symbol in each case. Referring now to the figures of the drawing in detail and first, particularly, to FIG. 1 thereof, there is shown a printing press 1 for lithographic offset printing. The printing press 1 contains, inter alia, a form cylinder 2 and a damping unit 3. The damping unit 3 contains, inter alia, a first roller 4, a second roller 5 and an applicator roller 6 which rollers on the form cylinder 2. In the first exemplary embodiment, the first roller 4 is a dip roller which scoops damping solution out of a damping solution fountain 7. As what is known as a transfer roller, the second roller 5 is in contact with both the first roller 4 and the applicator roller 6. Moreover, the second roller 5 is a metering roller, which rotates at a substantially slower peripheral speed than the applicator roller 6 and, as a result, meters the damping solution as what is known as a slip roller. The first roller 4 has a rotational axis 8 and the second roller 5 has a rotational axis 9.

During the adjustment of an axial spacing a between the rotational axes 8, 9, the first roller 4 is displaced along a first line of movement BL1, for example toward the second roller 5. The axial spacing adjustment is also known as feed setting. The first line of movement BL1 is straight and extends through the rotational axes 8, 9. Furthermore, the first roller 4 has a first roller end 4.1 and a second roller end 4.2. An axial roller center 4.3, which is indicated in the drawing by a phantom line lies between the two roller ends 4.1 and 4.2.

A second line of movement BL2 is actually a projection, which is perpendicular with respect to the image plane of FIG. 1, of pivoting circular arcs, along which the roller ends 4.1, 4.2 are pivoted during the oblique position adjustment. The two lines of movement BL1, BL2 lie in a plane which is perpendicular with respect to the rotational axes 8, 9, namely the image plane of FIG. 1. During the oblique position adjustment, what is known as the offsetting, of the first roller 4, its roller ends 4.1, 4.2 are displaced in opposite directions to one another along the second line of movement BL2.

On account of the fact that the second line of movement BL2 extends perpendicularly with respect to the first line of movement BL1, the oblique position adjustment does not result in any undesired change in the axial spacing a at the roller center 4.3. The oblique position adjustment is thus carried out free from disruptive reaction effects on the axial spacing adjustment. On account of the fact that the second line of movement BL2 extends in a straight line, the oblique position adjustment results in a desired increase in the axial spacing between the rotational axes 8, 9 at the roller ends 4.1, 4.2. As a result of the increased axial spacing at the roller ends 4.1, 4.2 which is denoted by the designation a', the roller pressure is reduced in a more pronounced manner from the roller center 4.3 toward the roller ends 4.1, 4.2 and is equalized as a result, that is to say is set to one and the same pressure value in the entire region which lies between the roller ends 4.1, 4.2. Deflection of the rotational axes 8, 9 which is caused by external forces (pressure force, bearing forces) is thus compensated for by the oblique position adjustment.

Figure 2:
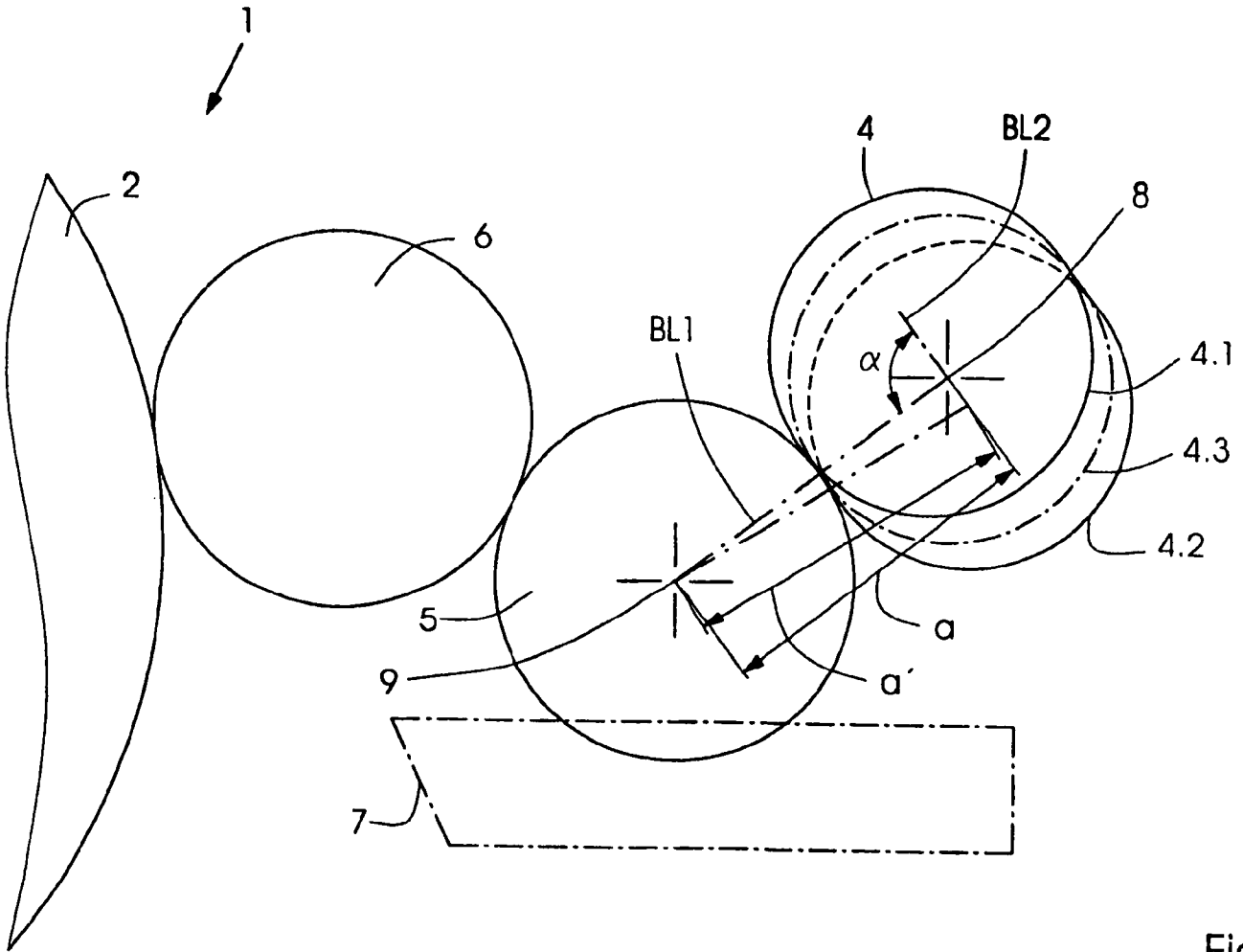
FIG. 2 is a diagrammatic illustration of a second exemplary embodiment, in which a metering roller is offset and the feed setting is likewise carried out along a straight line.

FIG. 2 shows a second exemplary embodiment. According to the second exemplary embodiment, the first roller 4 is a metering roller and the second roller 5 is a dip roller that dips into the damping solution fountain 7. As was also the case in the damping unit 3 shown in FIG. 1, the first roller 4 is also in contact only with the second roller 5 according to FIG. 2. The first roller 4 functions as what is known as a squeezing roller when metering the damping solution.

As was also the case in the first exemplary embodiment, the oblique position adjustment and the axial spacing adjustment are brought about in the second exemplary embodiment by moving one and the same roller, namely the first roller 4. Therefore, also in the second exemplary embodiment, during the oblique position adjustment and the axial spacing adjustment, that one of the two rollers is moved which is in contact only with a single roller. That which has already been explained in detail with regard to the linearity and orientation of the lines of movement BL1, BL2 and with regard to the axial spacings a, a' in conjunction with FIG. 1 also applies in the equivalent sense to the second exemplary embodiment shown in FIG. 2. The lines of movement BL1, BL2 also enclose a right angle in the latter case. In conjunction with the present invention, the right angle is understood as an angle which is from 80° to 100°, preferably from 85° to 95°, and for example 90° taking into consideration the manufacturing tolerances of the roller mounting.

Figure 3:
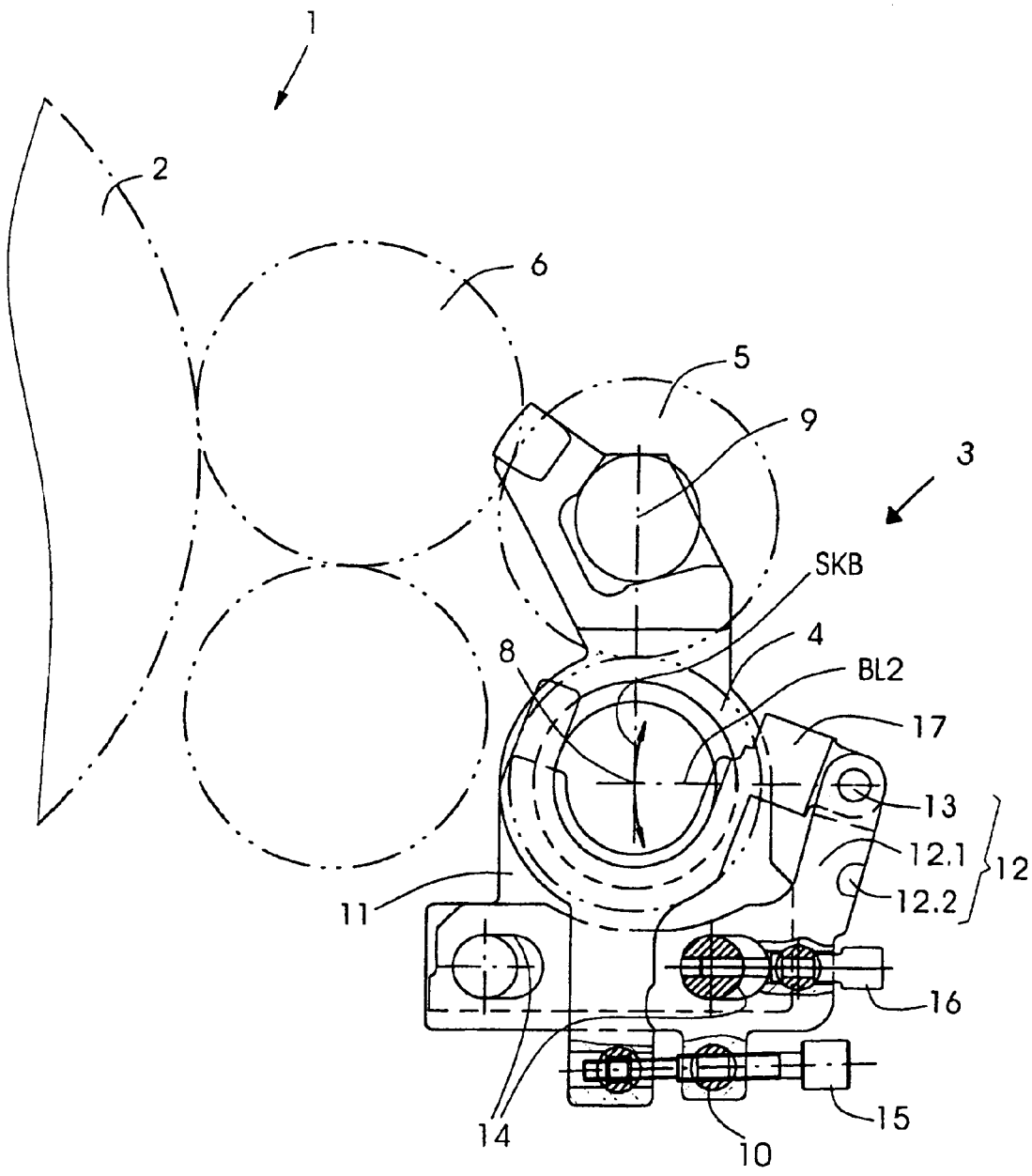
FIGS. 3 to 5 are diagrammatic illustrations showing a third exemplary embodiment, in which the dip roller is offset and the feed setting is carried out along a pivoting circular arc.
Figure 4:
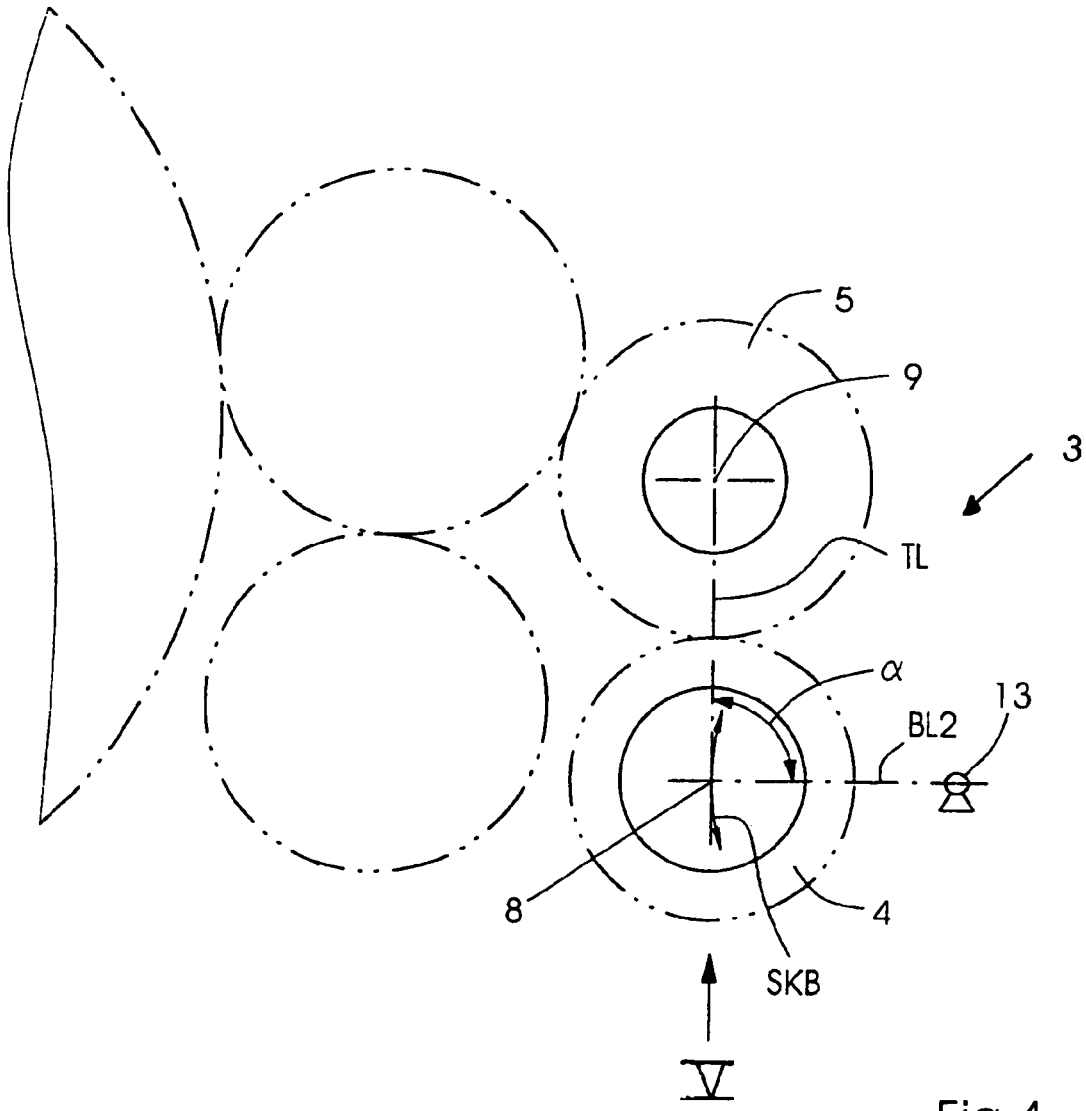
Figure 5:
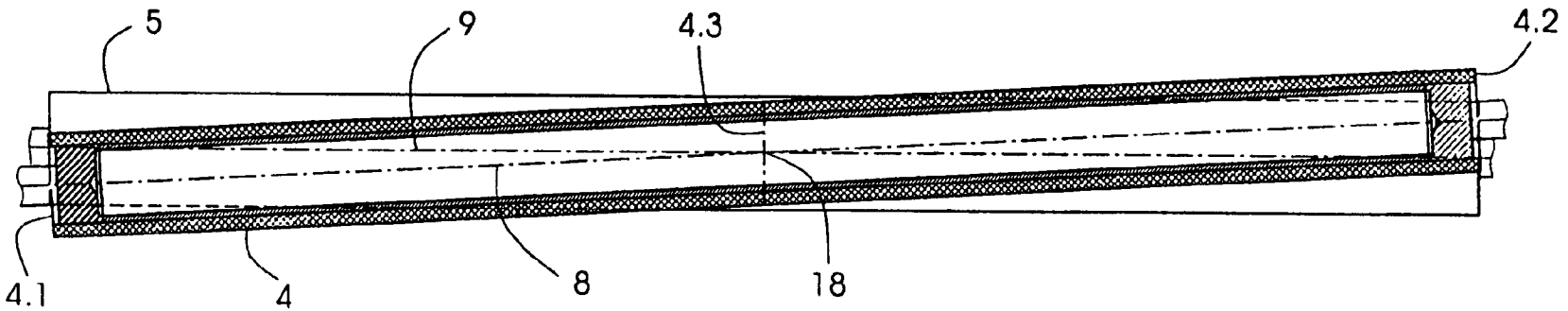

The damping unit 3 of the third exemplary embodiment according to FIGS. 3 to 5 corresponds to the first exemplary embodiment with regard to its types of rollers and configuration of rollers, and differs from the latter in the shape of the first line of movement BL1, which is a pivoting circular arc SKB in the third exemplary embodiment.

A roller mounting 10 which makes possible the adjusting movements, which are necessary for the offsetting and feed setting of the first roller 4 contains a main frame 11 and an auxiliary frame 12 having a first frame part 12.1 and a second frame part 12.2. The frame parts 12.1, 12.2 are connected to a lever 17 in each case via a rotary joint 13. In FIG. 3, the second frame part 12.2, its lever 17 and its rotary joint 13, which are disposed on the operating side of the printing press 1, are concealed to a very large extent by the first frame part 12.1, its lever 17 and its rotary joint 13, which are disposed on the drive side. The frame parts 12.1, 12.2 are connected to the main frame 11 in each case via a thrust joint 14, specifically a linear guide in the form of a slotted guide or a slot. The first roller 4 is mounted rotatably in the drive-side lever 17 at its first roller end 4.1 and in the operating-side lever 17 at its second roller end 4.2.

During the axial spacing adjustment, the rotational axis 8 of the first roller 4 is displaced along the pivoting circular arc SKB, in that the levers 17 are pivoted about the rotary joints 13 and relative to the auxiliary frame 12, by in each case a first threaded spindle 15. During the oblique position adjustment, the frame parts 12.1, 12.2 are displaced along thrust joints 14 in opposite directions to one another by use of in each case a second threaded spindle 16. As a consequence, the rotational axis 8 is pivoted at the first roller end 4.1 and at the second roller end 4.2 in mutually opposite directions along the second line of movement BL2. The pivoting movement of the rotational axis 8 takes place in one plane, namely the image plane of FIG. 5, and without movement components which are perpendicular with respect to said plane; the first roller 4 is thus not "wound" helically around the second roller 5.

In FIG. 4, the damping unit 3 from FIG. 3 is reproduced diagrammatically, in order to show clearly that the second line of movement BL2 extends perpendicularly with respect to a tangential line TL, which is tangent on the pivoting circular arc SKB in the rotational axis 8. The tangential line TL and the second line of movement BL2 enclose the abovementioned right angle.

FIG. 5, which is based on the viewing direction V (see FIG. 4), proceeds from the assumption that, for the purpose of the oblique position adjustment, the two frame parts 12.1, 12.2 are displaced linearly to the same extent, with the result that an imaginary pivot axis 18 of the pivoting movement of the rotational axis 8 lies exactly in the roller center 4.3. The pivot axis 18 marks that point at which the axial spacing between the rotational axes 8 and 9 does not change during the oblique position adjustment.

Figure 6:
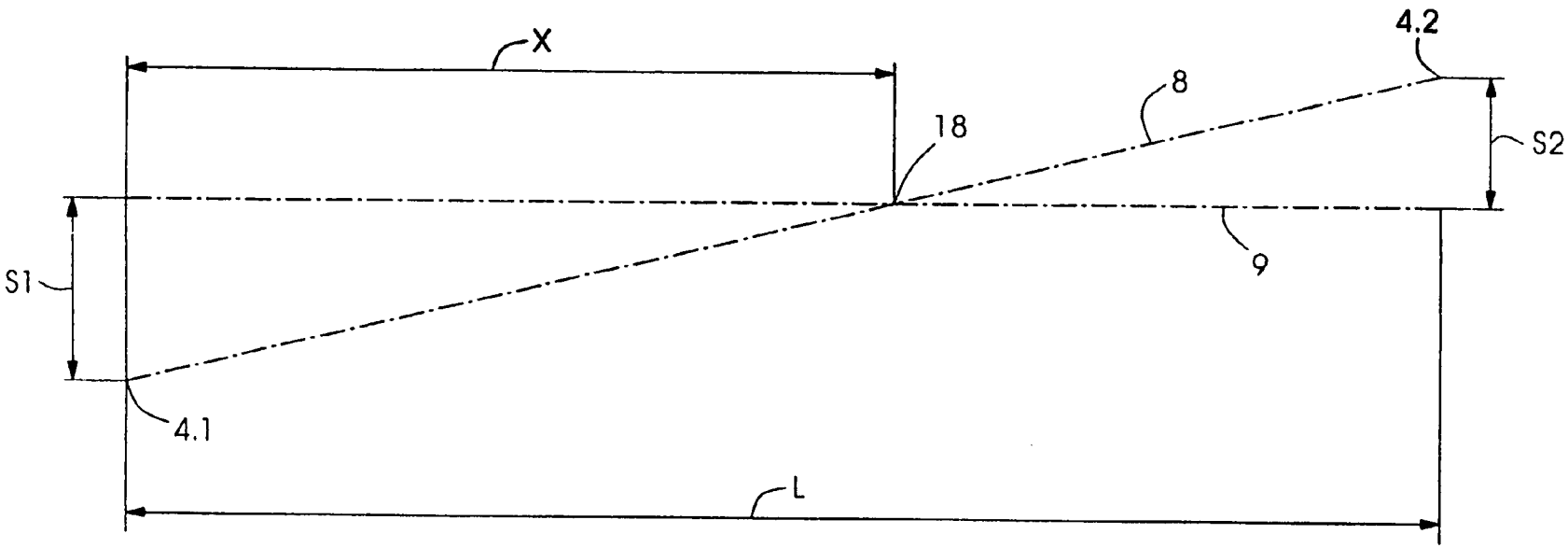
FIG. 6 is an outline illustration of the offsetting which is valid for all the exemplary embodiments.

FIG. 6 shows in a very diagrammatic manner that the pivot axis 18 can be deliberately set off-center with regard to the rollers 4, 5, in that, during offsetting, a displacement path S1 of the first roller end 4.1 is selected to be greater (or, instead, smaller) than an actuating path S2 of the second roller end 4.2, it being intended to measure the two actuating paths S1, S2 along the second line of movement BL2 (see FIGS. 1, 2 and 4). The pivot axis 18 can be displaced along the rotational axes 8, 9 in an infinitely variable manner by appropriate variations of the dimensional ratio of the adjusting paths S1 and S2 relative to one another. A location coordinate X (related, for example to the drive side) of the pivot axis 18 can be calculated in the following way, starting from a known mounting spacing L of the roller mounting 10:

$$X = \frac{S1}{S1 + S2} L.$$

The result of this calculation can be used as the basis for a manual or automated setting of the position of the pivot axis 18, that is to say the position of the minimum change of the axial spacing of the rotational axes 8, 9 relative to one another as a consequence of the offsetting.

This application claims the priority, under 35 U.S.C. § 119, of German patent application No. 10 2004 022 001.8, filed May 3, 2004; the entire disclosure of the prior application is herewith incorporated by reference.

We claim:

1. A method for roller adjustment in a printing press containing rollers including a first roller and a second roller in contact with the first roller, which comprises the steps of:

carrying out an axial spacing adjustment of one of the rollers relative to the other one of the rollers along a straight, first line of movement; and carrying out an oblique position adjustment of one of the rollers relative to the other one of the rollers out along a straight, second line of movement extending perpendicularly with respect to the first line of movement.

2. The method according to claim 1, wherein one of the first and second rollers is a dip roller.

3. The method according to claim 1, wherein a first roller end and a second roller end of the roller which is adjusted during the oblique position adjustment are displaced in opposite directions to one another.

4. The method according to claim 1, wherein the first roller end is displaced in the method farther than the second roller end.

5. A method for roller adjustment in a printing press containing rollers including a first roller and a second roller in contact with the first roller, which comprises the steps of:

carrying out an axial spacing adjustment of one of the rollers relative to the other one of the rollers along a pivoting circular arc; and carrying out an oblique position adjustment of one of the rollers relative to the other one of the rollers along a straight line of movement extending perpendicularly with respect to a tangential line of the pivoting circular arc, the tangential line extending through a rotational axis of the roller being moved along the pivoting circular arc during the axial spacing adjustment.

6. The method according to claim 5, wherein one of the first and second rollers is a dip roller.

7. The method according to claim 5, wherein a first roller end and a second roller end of the roller which is adjusted during the oblique position adjustment are displaced in opposite directions to one another.

8. The method according to claim 7, wherein the first roller end is displaced in the method farther than the second roller end.

9. A printing press, comprising:

a damping unit containing rollers including a first roller and a second roller in contact with said first roller and an adjustable roller mounting configured for adjusting said rollers such that:

an axial spacing adjustment of one of said rollers relative to said other one of said rollers along a straight, first line of movement can be carried out; and an oblique position adjustment of one of said rollers relative to the other one of said rollers along a straight, second line of movement extending perpendicularly with respect to the first line of movement can be carried out.

10. A printing press, comprising:

a damping unit containing rollers including a first roller and a second roller in contact with said first roller and an adjustable roller mounting configured for adjusting said rollers such that:

an axial spacing adjustment of one of said rollers relative to the other one of said rollers along a pivoting circular arc can be carried out; and an oblique position adjustment of one of said rollers relative to the other one of said rollers along a straight line of movement extending perpendicularly with respect to a tangential line of the pivoting circular arc can be carried out, the tangential line extending through a rotational axis of said roller being moved along the pivoting circular arc during the axial spacing adjustment.

* * * * *